US009474332B1

(12) United States Patent
Naranjo

(10) Patent No.: US 9,474,332 B1
(45) Date of Patent: Oct. 25, 2016

(54) BUCKLE APPARATUS TO ADJUST STRAP LENGTH OF A BAG

(71) Applicant: Richard Naranjo, Los Angeles, CA (US)

(72) Inventor: Richard Naranjo, Los Angeles, CA (US)

( * ) Notice: Subject to any disclaimer, the term of this patent is extended or adjusted under 35 U.S.C. 154(b) by 0 days.

(21) Appl. No.: 14/819,148

(22) Filed: Aug. 5, 2015

Related U.S. Application Data

(60) Provisional application No. 62/034,857, filed on Aug. 8, 2014.

(51) Int. Cl.
*A44B 11/18* (2006.01)
*A44B 11/02* (2006.01)
*A45C 13/30* (2006.01)

(52) U.S. Cl.
CPC ..... *A44B 11/18* (2013.01); *A44B 11/02* (2013.01); *A45C 13/30* (2013.01)

(58) Field of Classification Search
CPC ..... A44B 11/02; A44B 11/04; A44B 11/005; A44B 11/00; A41F 15/00; A41F 15/02; A41F 15/002; A45C 13/30
USPC ..... 24/197
See application file for complete search history.

(56) References Cited

U.S. PATENT DOCUMENTS 700,828 A * 5/1902 Rubin ..... A44B 11/04 24/184
1,059,303 A * 4/1913 Kerngood ..... A44B 11/04 24/194
1,195,664 A * 8/1916 Ecker ..... A44B 11/04 24/186
1,351,728 A * 9/1920 Auerbach ..... A44B 11/04 24/198
2,058,931 A * 10/1936 Williams ..... A44B 11/04 24/200
2,099,199 A * 11/1937 Devendor ..... A44B 11/04 2/268
3,066,374 A * 12/1962 Garson ..... A41F 15/002 24/198
3,672,004 A * 6/1972 Smith ..... B60P 7/0823 2/323
4,417,372 A * 11/1983 Ronci ..... A43C 11/1413 24/163 R
9,173,455 B2 * 11/2015 Chapron ..... A44B 11/04
2002/0148081 A1 * 10/2002 Ide ..... A44B 11/04 24/324
2004/0093700 A1 * 5/2004 Frangesh ..... A44B 11/04 24/169
2011/0239416 A1 * 10/2011 Shinya ..... A44B 11/04 24/457

* cited by examiner

*Primary Examiner* — Robert J Sandy
*Assistant Examiner* — Rowland Do
(74) *Attorney, Agent, or Firm* — Plager Schack LLP

(57) ABSTRACT

A buckle apparatus for use in adjusting a length of a strap coupled to a bag includes a slider buckle having a pair of openings and a loop member coupled to the bottom face of the slider buckle to permit the strap to extend within the loop member and through the pair of openings in the slider buckle, and an anchor buckle having a pair of openings, a pair of loop members coupled to the bottom face of the anchor buckle and at least one clip coupled to the top face of the anchor buckle. The strap extends within the loop members and openings in the anchor buckle. A user can retract an adjusted loop portion above the openings in the slider buckle and secure the loop portion to the at least one clip of the anchor buckle, thereby shortening the strap length.

5 Claims, 5 Drawing Sheets

BUCKLE APPARATUS TO ADJUST STRAP LENGTH OF A BAG

RELATED APPLICATION

The application claims priority to provisional patent application U.S. Ser. No. 62/034,857 filed on Aug. 8, 2014, the entire contents of which is herein incorporated by reference.

BACKGROUND

The embodiments herein relate generally to adjustable buckles used to alter the length of a strap.

The majority of bags including purses, backpacks, carrying cases and duffel bags include at least one shoulder strap. This strap is often placed around a user's shoulder to help carry the bag and stored contents. Users of these bags have a need to lengthen or shorten the shoulder strap to fit around the body more comfortably or permit the strap to be effectively used as a hand strap.

There exist a variety of buckles coupled to bag straps that permit a user to shorten or lengthen the strap as desired. In these devices, one or more buckles are secured to the strap. However, these one or more buckles are limited when in use because they lack durability and/or sometimes unintentionally slip and fail to retain the strap in the desired length. In addition, these buckles do not effectively anchor a retracted loop portion of the strap during a length adjustment, which detracts from the aesthetics and/or safe use of the bag.

As such, there is a need in the industry for a buckle apparatus that addresses the limitations of the prior art.

SUMMARY

A buckle apparatus for use in adjusting a length of a strap coupled to a bag is provided. The buckle apparatus comprises an enhanced grip to secure an adjusted loop portion of the strap in place. The buckle apparatus comprises a slider buckle coupled to the strap and comprising a top face and a bottom face, the slider buckle comprising a pair of openings and a loop member coupled to the bottom face of the slider buckle, wherein the strap extends within the loop member and through the pair of openings in the slider buckle, and an anchor buckle coupled to the strap and comprising a top face and a bottom face, the anchor buckle comprising a pair of openings, a pair of loop members coupled to the bottom face of the anchor buckle and at least one clip coupled to the top face of the anchor buckle, wherein the strap extends within the pair of loop members and pair of openings in the anchor buckle, wherein a user can retract the adjusted loop portion above the pair of openings in the slider buckle and secure the adjusted loop portion to the at least one clip of the anchor buckle, thereby shortening the length of the strap.

In certain embodiments, a second clip is coupled to the top face of the anchor buckle, which permits the adjusted loop portion to be secured to the first and second clips of the anchor buckle. In certain embodiments, the loop members of the buckle apparatus may comprise teeth to enhance grip with the strap. In certain embodiments, the openings of the buckle apparatus may comprise one or more sets of teeth to enhance grip with the strap.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
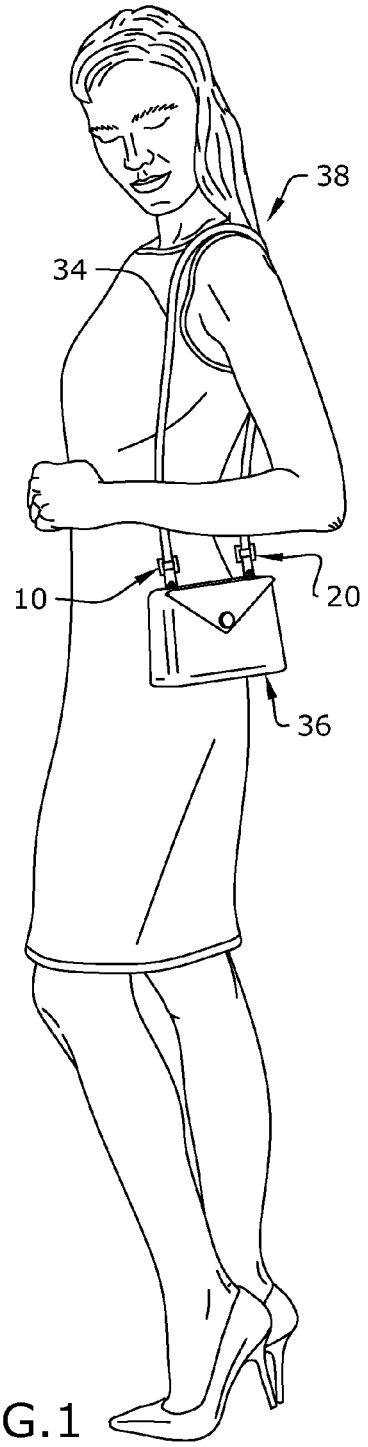
FIG. 1 depicts a perspective view of certain embodiments of the buckle apparatus shown in use with the strap in a lengthened configuration.
Figure 2:
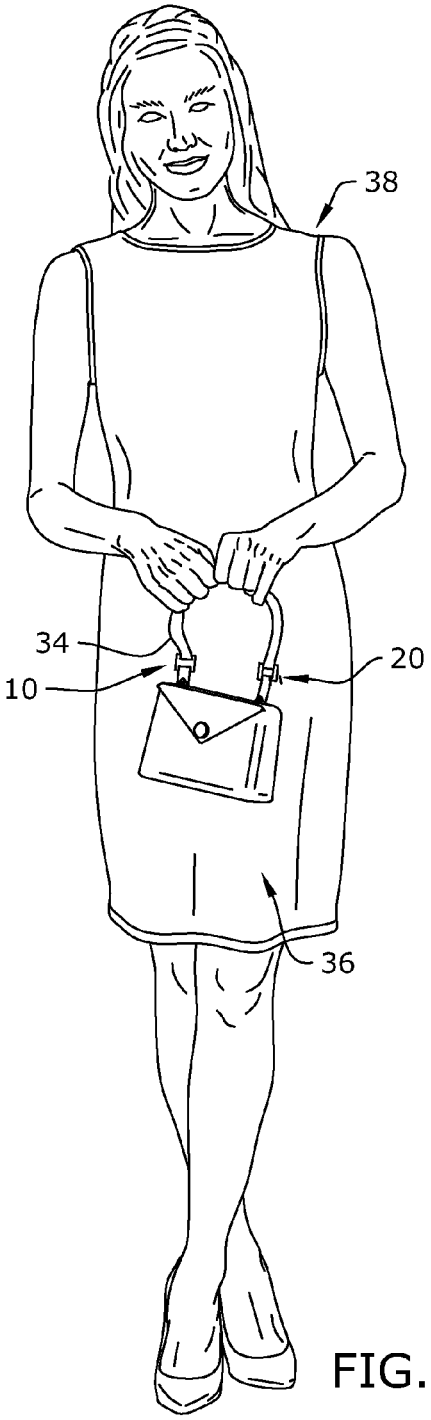
FIG. 2 depicts a perspective view of certain embodiments of the buckle apparatus shown in use with the strap in a shortened configuration.
Figure 3:
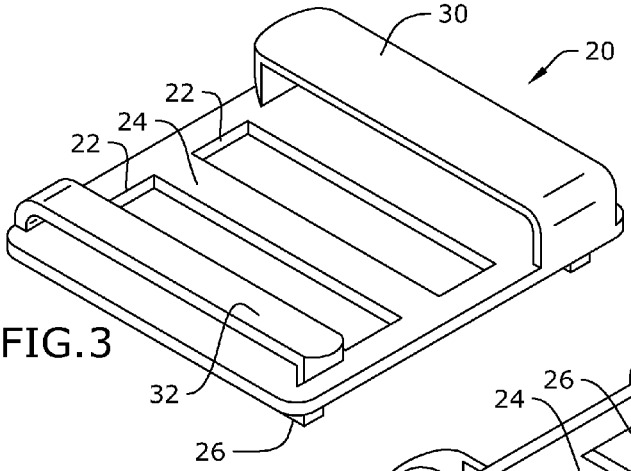
FIG. 3 depicts a top perspective view of certain embodiments of the buckle apparatus illustrating clips buckle 20.
Figure 4:
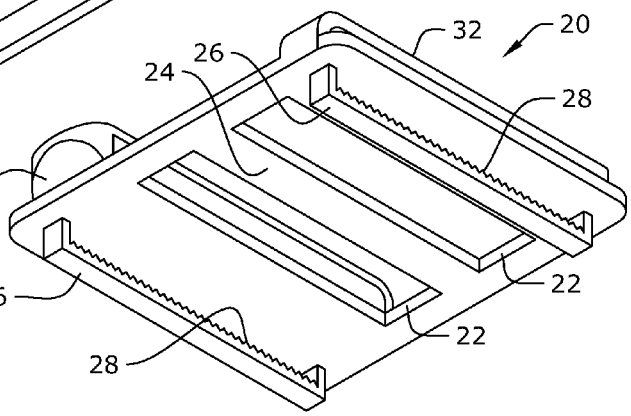
FIG. 4 depicts a bottom perspective view of certain embodiments of the buckle apparatus illustrating clips buckle 20.
Figure 5:
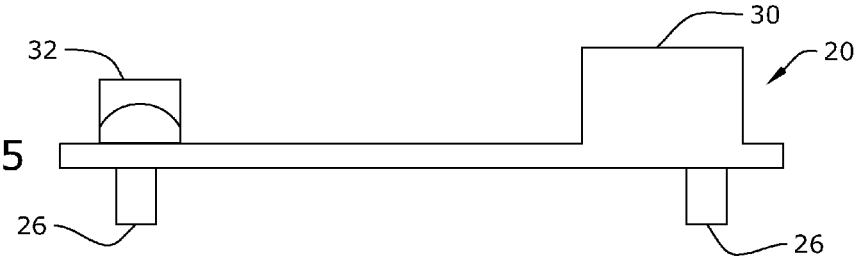
FIG. 5 depicts a side view of certain embodiments of the buckle apparatus illustrating clips buckle 20.
Figure 6:
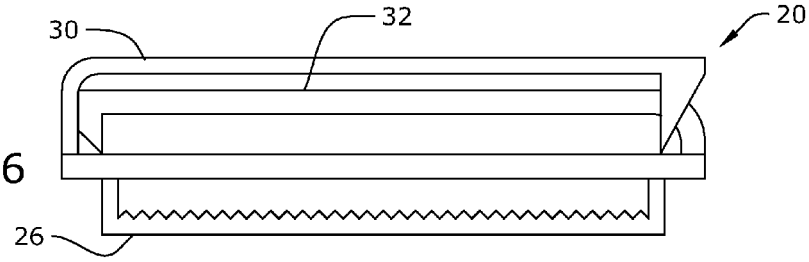
FIG. 6 depicts a side view of certain embodiments of the buckle apparatus illustrating clips buckle 20.
Figure 7:
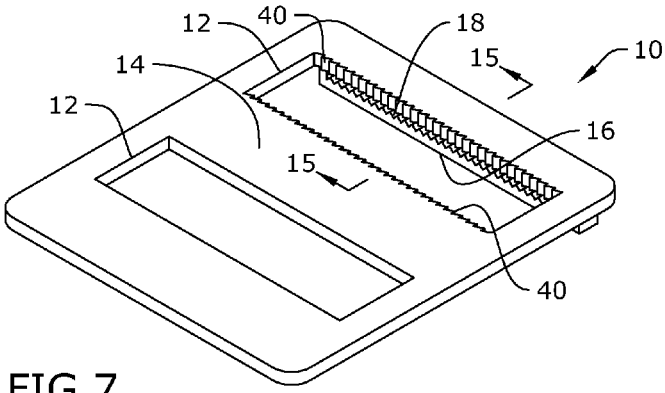
FIG. 7 depicts a top perspective view of certain embodiments of the buckle apparatus illustrating slider buckle 10.
Figure 8:
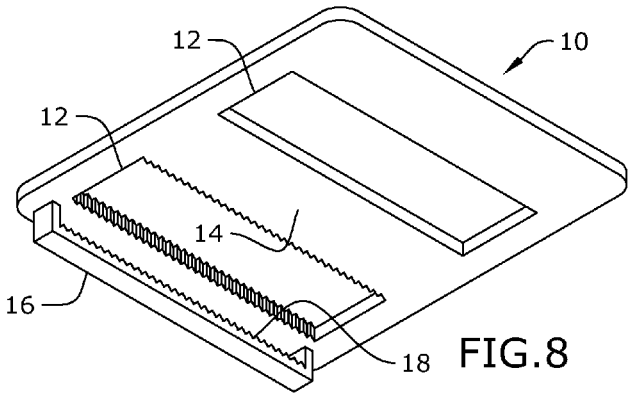
FIG. 8 depicts a bottom perspective view of certain embodiments of the buckle apparatus illustrating slider buckle 10.
Figure 9:
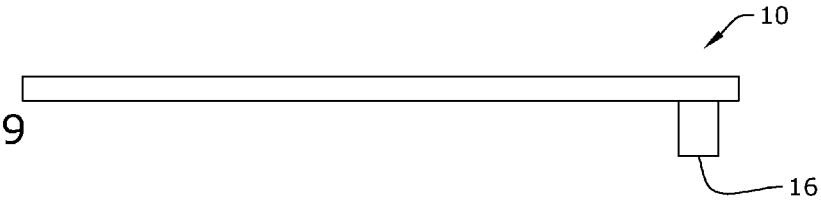
FIG. 9 depicts a side view of certain embodiments of the buckle apparatus illustrating slider buckle 10.
Figure 10:
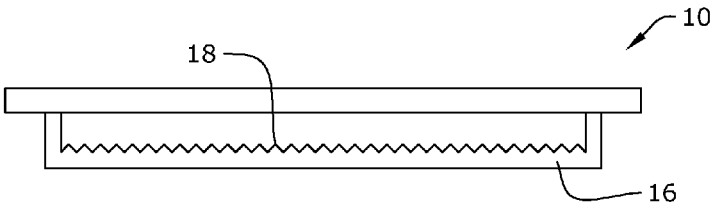
FIG. 10 depicts a side view of certain embodiments of the buckle apparatus illustrating slider buckle 10.

As depicted in FIGS. 1-2, the buckle apparatus is configured for use with strap 34 coupled to bag 36 carried by operator 38. The buckle apparatus comprises slider buckle 10 and clips buckle 20, which are used in conjunction with one another to permit operator 38 to adjust the length of strap 34 to either a lengthened or shortened configuration. Although the figures depict bag 36 as a purse, it shall be appreciated that any alternative type of bag known in the field may be used instead.

As depicted in FIGS. 3-6, clips buckle 20 serves as an anchor buckle and comprises a pair of clips buckle body openings 22, clips buckle center divider 24, small clip 32, large clip 30 and a pair of clips buckle lower loops 26. Small clip 32 and large clip 30 are affixed to the top face of clips buckle 20. Clips buckle lower loops 26 are affixed to the bottom face of clips buckle 20. Each clips buckle lower loop 26 comprises clips buckle lower loop teeth 28, which are directed toward the bottom face of clips buckle 20.

As depicted in FIGS. 7-10, slider buckle 10 comprises a pair of slider buckle body openings 12, slider buckle center divider 14 and slider buckle lower loop 16. Slider buckle lower loop 16 is affixed to the bottom face of slider buckle 10 and comprises slider buckle lower loop teeth 18, which are directed toward the bottom face of slider buckle 10. In one embodiment, the slider buckle body opening 12 proximate slider buckle lower loop 16 comprises slider buckle body opening teeth (Type A) 40, which are disposed on opposing side edges of the body opening.

It shall be appreciated that clips buckle 20 and slider buckle 10 may be made from any materials known in the field including, but not limited to, any metal, wood, plastic, or the like. In addition, clips buckle 20 and slider buckle 10 may be any color and have any patterns or finishing glosses to match with bag 36 and/or each other. In certain embodiments, clips buckle 20 and slider buckle 10 may have one or more logos engraved thereto and finished with the same or different colors as the buckles.

Figure 11:
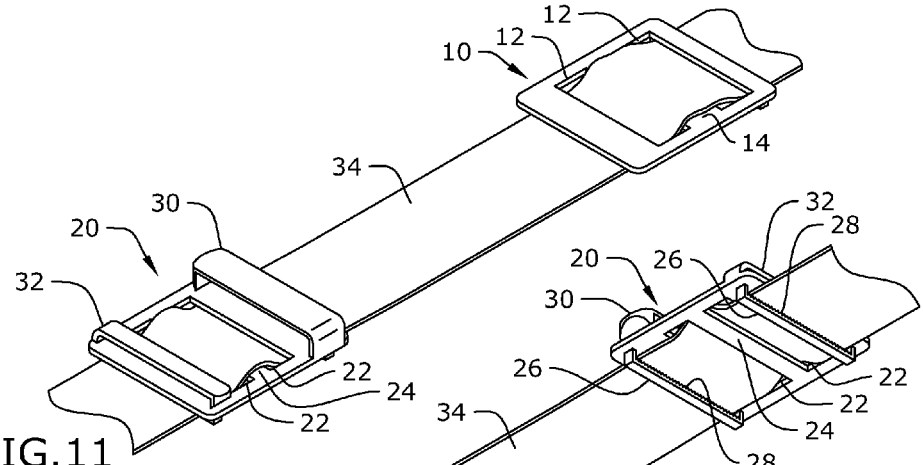
FIG. 11 depicts a top perspective view of certain embodiments of the buckle apparatus shown in use with the strap in a lengthened configuration.
Figure 12:
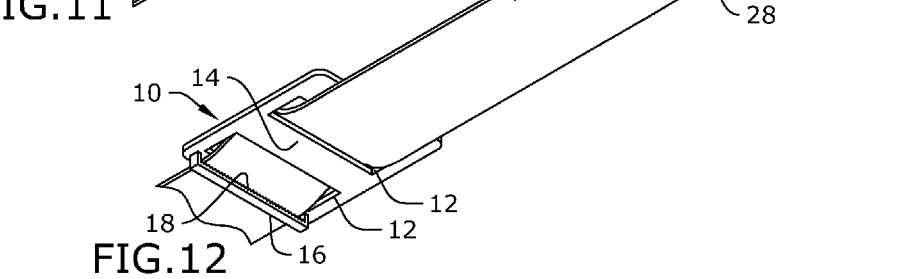
FIG. 12 depicts a bottom perspective view of certain embodiments of the buckle apparatus shown in use with the strap in a lengthened configuration.

In operation, clips buckle 20 and slider buckle 10 are coupled to strap 34 on opposing ends as shown in FIG. 1. As depicted in FIGS. 11-12, strap 34 may be configured in a lengthened configuration. In this configuration, strap 34 is inserted through the bottom side of slider buckle 10 through slider buckle lower loop 16. Strap 34 then extends up through the first slider buckle body opening 12, around slider buckle center divider 14, and down through the second slider buckle body opening 12. Strap 34 then extends to clips buckle 20 and is inserted through a first clips buckle lower loop 26. Strap 34 then extends up through the first clips buckle body opening 22, around clips buckle center divider 24, down through the second slider buckle body opening 22, and through the second clips buckle lower loop 26. Slider buckle body opening teeth (Type A) 40, slider buckle lower loop teeth 18 and clips buckle lower loop teeth 28 contact strap 34 and enhance the grip between the strap and buckles 10, 20.

Figure 13:
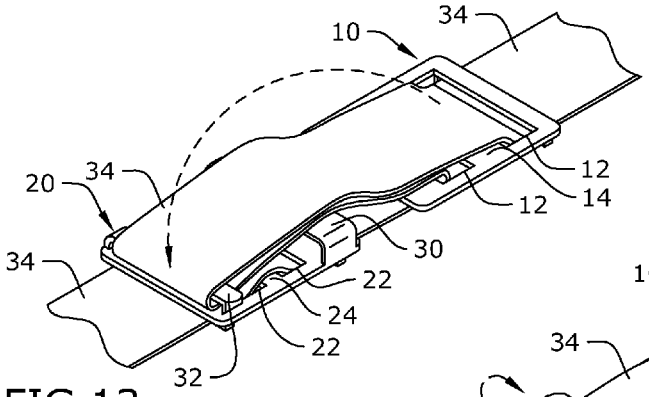
FIG. 13 depicts a top perspective view of certain embodiments of the buckle apparatus shown in use with the strap in a shortened configuration.
Figure 14:
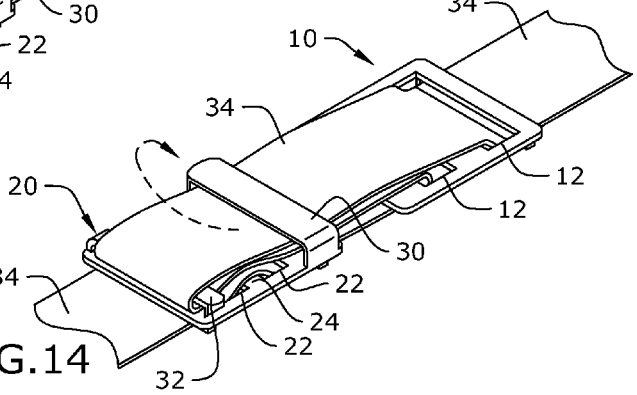
FIG. 14 depicts a top perspective view of certain embodiments of the buckle apparatus shown in use with the strap in a shortened and secured configuration.

As depicted in FIG. 13, the length of strap 34 can be shortened by pulling a portion of strap 34 above slider buckle body openings 12 to create a refracted adjustment loop. As such, slider buckle body opening 12 positioned closest to clips buckle 20 permits the portion of strap 34 between the buckles 10, 20 to slide through to create the retracted adjustment loop. The retracted adjustment loop is folded over and disposed around small clip 32 of clips buckle 20. As depicted in FIG. 14, the retracted adjustment loop can be further anchored into place by placing the refracted adjustment loop within large clip 30 of clips buckle 20. In this secured configuration, strap 34 is tidy and in a shortened configuration. It shall be appreciated that a user can easily return strap 34 to the lengthened configuration by removing the retracted adjustment loop from small clip 32 and large clip 30, and feeding the adjustment loop back through the slider buckle body opening 12 in the reverse direction.

Figure 15:
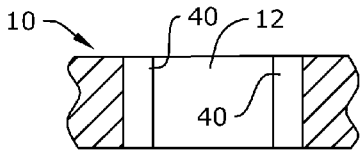
FIG. 15 depicts a section view of certain embodiments of the buckle apparatus taken along line 15-15 in FIG. 7.
Figure 17:
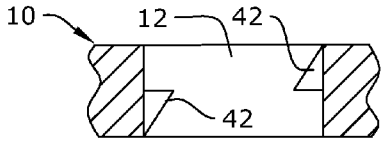
FIG. 17 depicts a section view of an alternative embodiment of the buckle apparatus.
Figure 16:
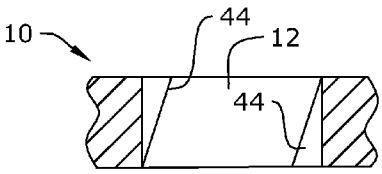
FIG. 16 depicts a section view of an alternative embodiment of the buckle apparatus.

The buckle apparatus may have several alternative embodiments. For example, the teeth on slider buckle 10 may have variable sizes and shapes. FIG. 15 depicts a cross-section view of slider buckle body opening teeth (Type A) 40, which are oriented substantially parallel to opposing side edges of slider buckle body opening 12. FIG. 16 depicts an alternative embodiment in which slider buckle body opening teeth (Type B) 44 are slanted relative to opposing side edges of slider buckle body opening 12. FIG. 17 depicts an alternative embodiment in which slider buckle body opening teeth (Type C) 42 are slanted relative to opposing side edges of slider buckle body opening 12, and disposed on a portion of each side edge.

Figure 18:
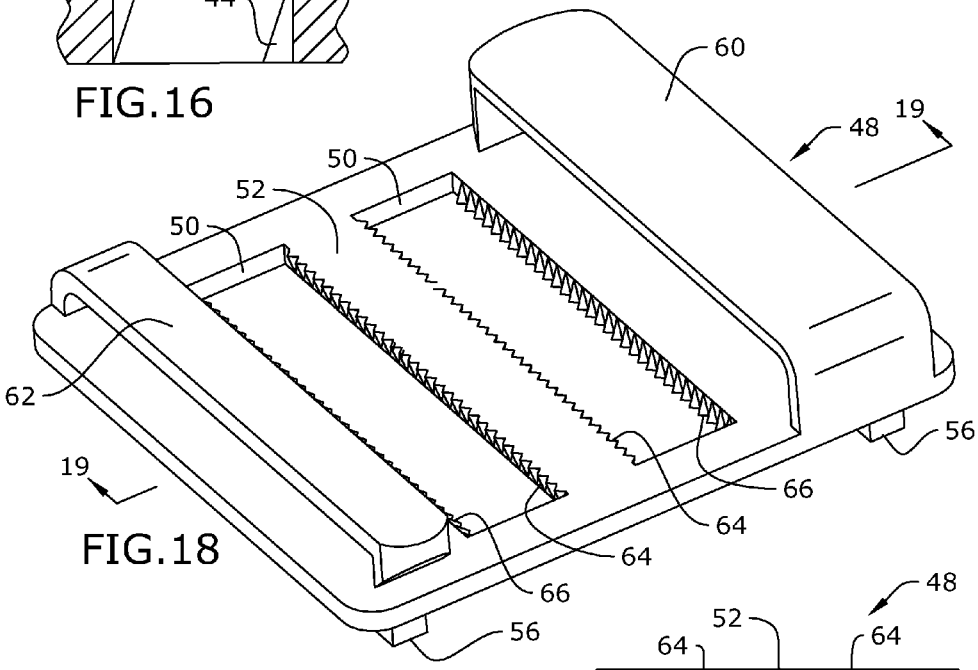
FIG. 18 depicts a perspective view of an alternative embodiment of the buckle apparatus.
Figure 21:
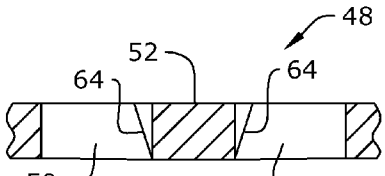
FIG. 21 depicts a section view of an alternative embodiment of the buckle apparatus.
Figure 19:
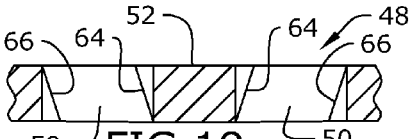
FIG. 19 depicts a section view of an alternative embodiment of the buckle apparatus taken along line 19-19 in FIG. 18.
Figure 20:
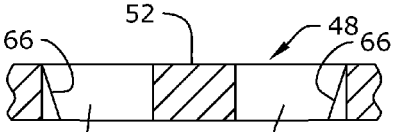
FIG. 20 depicts a section view of an alternative embodiment of the buckle apparatus.

As depicted in FIG. 18, alternate clips buckle 48 may be used instead of clips buckle 20. Alternate clips buckle 48 shares components substantially similar to clips buckle 20, which comprises a pair of alternate clips buckle body openings 50, alternate clips buckle center divider 52, alternate small clip 62, alternate large clip 60 and a pair of alternate clips buckle lower loops 56. In certain embodiments, alternate clips buckle 48 comprises inner divider teeth 64 and clips buckle body opening outer teeth 66 disposed on opposing side edges of each clips buckle body opening 50. FIG. 19 depicts a cross-section view of inner divider teeth 64 and clips buckle body opening outer teeth 66 on alternate clips buckle 48. It shall be appreciated that any combination of teeth may be used instead. For example, alternate clips buckle 48 may only comprise clips buckle body opening outer teeth 66 as depicted in FIG. 20. In certain embodiments, alternate clips buckle 48 may only comprise inner divider teeth 64 as depicted in FIG. 21.

It shall be appreciated that the components of the buckle apparatus described in several embodiments herein may comprise any alternative known materials in the field and be of any color, size and/or dimensions. It shall be appreciated that the components of the buckle apparatus described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A buckle apparatus for use in adjusting a length of a strap coupled to a bag, the buckle apparatus configured to secure an adjusted loop portion of the strap in place, the buckle apparatus comprising:

a slider buckle coupled to the strap and comprising a top face and a bottom face, the slider buckle comprising a pair of openings and a loop member coupled to the bottom face of the slider buckle, wherein the strap extends within the loop member and through the pair of openings in the slider buckle; and an anchor buckle coupled to the strap and comprising a top face and a bottom face, the anchor buckle comprising a pair of openings, a pair of loop members coupled to the bottom face of the anchor buckle and a pair of clips coupled to the top face of the anchor buckle, wherein the strap extends within the pair of loop members and the pair of openings in the anchor buckle, wherein the adjusted loop portion is configured to retract above the pair of openings in the slider buckle and adjust to secure the adjusted loop portion to the pair of clips of the anchor buckle, thereby shortening the length of the strap.

2. The buckle apparatus of claim 1, wherein the loop member of the loop member of the slider buckle and the pair of loop members of the anchor buckle comprise teeth configured to contact the strap.

3. The buckle apparatus of claim 2, wherein the pair of clips are positioned on opposite sides of the pair of openings of the anchor buckle.

4. The buckle apparatus of claim 3, wherein one opening of the pair of openings in the slider buckle comprises teeth disposed on opposing side edges of the one opening.

5. The buckle apparatus of claim 4, wherein opposing side edges of each opening in the pair of anchor buckle openings comprise teeth.

* * * * *